US008602035B2

(12) United States Patent
Kaljura

(10) Patent No.: US 8,602,035 B2
(45) Date of Patent: Dec. 10, 2013

(54) APPARATUS FOR THE MANUFACTURE OF SMOKING ARTICLES

(75) Inventor: Karl Kaljura, Southampton (GB)

(73) Assignee: British American Tobacco (Investments) Limited, London (GB)

( * ) Notice: Subject to any disclaimer, the term of this patent is extended or adjusted under 35 U.S.C. 154(b) by 897 days.

(21) Appl. No.: 12/525,526

(22) PCT Filed: Nov. 16, 2007

(86) PCT No.: PCT/GB2007/004397

§ 371 (c)(1),
(2), (4) Date: Mar. 26, 2010

(87) PCT Pub. No.: WO2008/071903

PCT Pub. Date: Jun. 19, 2008

(65) Prior Publication Data

US 2010/0180904 A1 Jul. 22, 2010

(30) Foreign Application Priority Data

Dec. 12, 2006 (GB) ..... 0624771.2

(51) Int. Cl.
*A24C 1/18* (2006.01)
*A24C 1/20* (2006.01)
*A24C 5/06* (2006.01)

(52) U.S. Cl.
USPC ..... 131/77; 131/360; 131/84.4; 131/83.1; 131/361; 131/39

(58) Field of Classification Search
None
See application file for complete search history.

(56) References Cited

U.S. PATENT DOCUMENTS

| | | | | |
|---|---|---|---|---|
| 2,250,381 | A | 7/1941 | Kayner | |
| 3,604,429 | A | 9/1971 | Witt | |
| 3,910,287 | A * | 10/1975 | Walton | 131/336 |
| 4,595,024 | A | 6/1986 | Greene et al. | |
| 4,646,762 | A | 3/1987 | Riehl et al. | |
| 4,771,794 | A | 9/1988 | Gaisser et al. | |
| 5,003,996 | A | 4/1991 | Tallier et al. | |
| 5,143,094 | A | 9/1992 | Nash et al. | |
| 5,501,233 | A | 3/1996 | Babey et al. | |

(Continued)

FOREIGN PATENT DOCUMENTS

| | | |
|---|---|---|
| DE | 4117641 A1 | 12/1991 |
| DE | 20309178 U1 | 9/2003 |

(Continued)

OTHER PUBLICATIONS

Japanese Office Action on related Japanese Application 2009-540832, including machine translation.

(Continued)

*Primary Examiner* — Richard Crispino
*Assistant Examiner* — Phu Nguyen
(74) *Attorney, Agent, or Firm* — N W Poulsen

(57) ABSTRACT

One embodiment of the invention provides apparatus for manufacturing a smoking article. The apparatus includes an ecreteur having at least one trimming disk configured to trim a tobacco rod for a smoking article to have at least one end region of increased tobacco density. The at least one trimming disk is further configured to trim a body region of the tobacco rod such that the body region has a variable tobacco mass per unit length, where the body region is distinct from said at least one end region of increased density.

7 Claims, 7 Drawing Sheets

(56) References Cited

U.S. PATENT DOCUMENTS

| | | | | |
|---|---|---|---|---|
| 6,202,651 | B1 * | 3/2001 | Luke et al. | 131/360 |
| 6,360,751 | B1 | 3/2002 | Fagg et al. | |
| 6,390,100 | B1 | 5/2002 | Schumacher | |
| 6,708,695 | B2 * | 3/2004 | Fagg et al. | 131/360 |
| 2004/0003822 | A1 | 1/2004 | Atindranath | |

FOREIGN PATENT DOCUMENTS

| | | | |
|---|---|---|---|
| EP | 0498265 | A | 8/1992 |
| EP | 0558254 | A | 9/1993 |
| GB | 1128685 | A | 10/1968 |
| GB | 2201879 | A | 9/1988 |
| JP | 2000-253865 | A | 9/2000 |
| WO | WO0054611 | A | 9/2000 |
| WO | WO2005082180 | * | 9/2005 |

OTHER PUBLICATIONS

PCT International Search Report and Written Opinion dated Dec. 12, 2006.

International Preliminary Report on Patentability, dated 2006.

* cited by examiner

APPARATUS FOR THE MANUFACTURE OF SMOKING ARTICLES

CLAIM FOR PRIORITY

This application is a National Stage Entry entitled to and hereby claims priority under 35 U.S.C. §§365 and 371 corresponding to PCT Application No. PCT/GB2007/004397, titled, "A smoking article and a method and apparatus for the manufacture of smoking articles," filed Nov. 16, 2007, which in turn claims priority to British Application Serial No. GB 0624771.2 filed Dec. 12, 2006, all of which are hereby incorporated by reference.

FIELD OF THE INVENTION

The present invention relates to smoking articles such as cigarettes and to a method and apparatus for the manufacture thereof.

BACKGROUND OF THE INVENTION

A known cigarette manufacturing technique, such as disclosed in U.S. Pat. No. 4,771,794, involves the use of a suction belt which takes tobacco from a hopper and forms a rod of tobacco that is fed into the garniture area of a cigarette manufacturing machine where the tobacco rod is wrapped in paper. The rod of tobacco that is formed in the suction belt area is not generally of a consistent enough weight or density to be used directly as a high quality cigarette. Accordingly, the tobacco rod is trimmed by an ecreteur to remove excess weight or density.

The removal processing is performed by a set of trimming disks. The trimming disks comprise two coplanar, rotating, disks adjacent to one another. The trimming disks shear off excess weight or density from a tobacco rod passing over or between them by the use of a paddle wheel or brush that rotates under the disks. The disks and brush may be moved up and down to remove more or less tobacco as required.

Cigarettes often have increased density of tobacco packing at either end of the cigarette to help prevent loose tobacco from falling out of the cigarette. Known trimming disks accommodate this by having pockets in the trimming disks that allow more tobacco to pass through the disk at either end of the tobacco rod and into the garniture area of the machine. In particular, the rotation of the two trimming disks is synchronised, so that the pockets form a symmetrical profile with respect to the cylindrical axis of the cigarette. Such an approach enables a dense end of tobacco to be formed at the open ends of the cigarette. The use of such dense ends has proved very effective for retaining tobacco within a cigarette.

In contrast, the remaining central portion (body) of cigarettes has generally been provided with a constant tobacco density, and the trimming disks for the manufacture of such cigarettes have been shaped accordingly.

SUMMARY OF THE INVENTION

One embodiment of the invention provides apparatus for manufacturing a smoking article including an ecreteur having at least one trimming disk configured to trim a tobacco rod for a smoking article to have at least one end region of increased tobacco density. The trimming disk is further configured to trim a body region of the tobacco rod such that the body region has a variable tobacco mass per unit length. The body region is distinct from the end region(s) of increased density.

Another embodiment of the invention provides apparatus for manufacturing a smoking article including an ecreteur having at least one trimming disk configured to trim a tobacco rod for a smoking article. The edge of the trimming disk has a first segment corresponding to at least one end region of increased tobacco density, a second segment corresponding to a portion of a body region where a dual wrap is to be accommodated, and a third segment corresponding to a remaining portion of the body region. The level of the third segment is intermediate the level of the first segment and the level of the second segment. (N.B. In some embodiments, the level may vary within a segment).

Another embodiment of the invention provides a smoking article comprising a tobacco rod having at least one end region of increased tobacco density. The tobacco rod further has a body region which has a variable tobacco mass per unit length. The body region is distinct from the end region(s) of increased density. The smoking article further comprises an inner wrap and an outer wrap. The inner wrap is coextensive with the first portion and the outer wrap extends over at least all of the body region. At any given position along the first portion, the tobacco mass per unit length and the size of the inner wrap combine to produce a constant density of tobacco along the first portion.

Another embodiment of the invention provides a smoking article including a tobacco rod having a region of variable tobacco mass per unit length along the tobacco rod. The density of tobacco in the region is substantially constant. Other embodiments of the invention provide a method and apparatus for manufacturing such a smoking article.

Another embodiment of the invention provides a method of manufacturing a smoking article. The method comprises trimming a tobacco rod for a smoking article to have at least one end region of increased tobacco density. The method additionally comprises trimming a body region of said tobacco rod such that the body region has a variable tobacco mass per unit length. The body region is distinct from the end region(s) of increased tobacco density. The trimming is performed using at least one ecreteur disk configured to trim the tobacco rod for a smoking article to have said at least one end region of increased tobacco density, and to trim the body region of the tobacco rod such that said body region has a variable tobacco mass per unit length, wherein said body region is distinct from said at least one end region of increased density.

As for known smoking articles, an end region having increased density of tobacco is (compared to the tobacco density of the body region) may be provided at the open end of the smoking article, and some smoking articles may also have an end region of increased tobacco density at the filter end. The body region of the smoking article represents the portion of the tobacco rod between the end regions of increased density (if there is no increased density at one end of the tobacco rod, then the body portion in effect includes or extends all the way to this end). In contrast to known cigarettes, the body region of the tobacco rod is trimmed to have a variable mass per unit length.

In one embodiment, trimming the body region involves forming a first portion of the body region having a lower tobacco mass per unit length than a second portion of the body region. The tobacco mass per unit length of the first portion of the body region may be substantially constant or variable along the length of the first portion, depending on the desired tobacco profile. The first portion may extend from one end of the body region (e.g. at the filter end of the smoking article) part-way along the body region, with the second portion then comprising the remainder of the body region. Another possibility is that the first portion may comprise a central portion of the body region, with the second portion then comprising the remainder of the body region. In other embodiments, more complicated configurations may be adopted, in terms of number of transitions and/or levels of tobacco mass per unit length.

In one embodiment, the smoking article is provided with an inner wrap and an outer wrap. The inner wrap is coextensive with the first portion, and the outer wrap extends over at least all of the body region (and generally any end region of increased density as well). The inner wrap might be provided for various purposes, for example to enhance flavouring and/or to reduce delivery of certain constituents of the smoke to the consumer during smoking. The reduced amount of tobacco in the portion of the smoking article having the dual wrap helps to avoid an increased density of tobacco in this region. For example, in one particular embodiment, at any given position of the first portion, the tobacco mass per unit length and the size of the inner wrap may combine to product a constant density of tobacco along the first portion (allowing for compression of the tobacco rod during wrapping). This helps to provide a constant density of tobacco throughout the body portion, which can enhance smoking and handling characteristics, as well as avoiding potential manufacturing problems, such as corrugations to the outer wrapping or rod breakouts (tobacco breaking through the wrapper).

Note that the tobacco mass per unit length may be varied even in smoking articles without an inner or dual wrap. For example, such variation might occur to improve filtering characteristics (bearing in mind that as a cigarette is burnt, the amount of filtering provided by the tobacco rod itself declines), perhaps to reduce product cost, etc.

In one embodiment, the edge of the ecreteur disk(s) varies in level corresponding to the variable tobacco mass per unit length of the body region. For example, the edge of the ecreteur disk(s) may have a first segment corresponding to the end region of increased tobacco mass per unit length, a second segment corresponding to a portion of the body region where a dual wrap is to be accommodated, and a third segment corresponding to a remaining portion of the body region, where the level of the third segment is intermediate the level of the first segment and the level of the second segment. The trimming may be performed using a pair of such disks.

In one embodiment, the trimming is further performed using at least one ecreteur brush. The radius of the ecreteur brush varies corresponding to the variable tobacco mass per unit length of the body region. For example, the radius of the ecreteur brush may have a first value corresponding to an end region of increased tobacco mass per unit length, a second value corresponding to a portion of the body region where a dual wrap is to be accommodated, and a third value corresponding to a remaining portion of the body region, wherein the third value is intermediate the first value and the second value.

In another embodiment, the ecreteur disk is flat around the circumference (i.e. has a constant level), while the ecreteur brush has a constant radius. The distance between the trimming disk and the central axis of the tobacco rod is controlled in correspondence with the desired variation in tobacco mass per unit length of the body region. In this case, the ecreteur disk and brush have a fixed relationship with one another, and move up or down together in order to trim more or less tobacco from the tobacco rod.

The apparatus and smoking article embodiments of the invention may benefit from the same additional features as described above in relation to the method embodiment.

BRIEF DESCRIPTION OF THE DRAWINGS

Various embodiments of the invention will now be described in detail by way of example only with reference to the following drawings.

DETAILED DESCRIPTION

Figure 1:
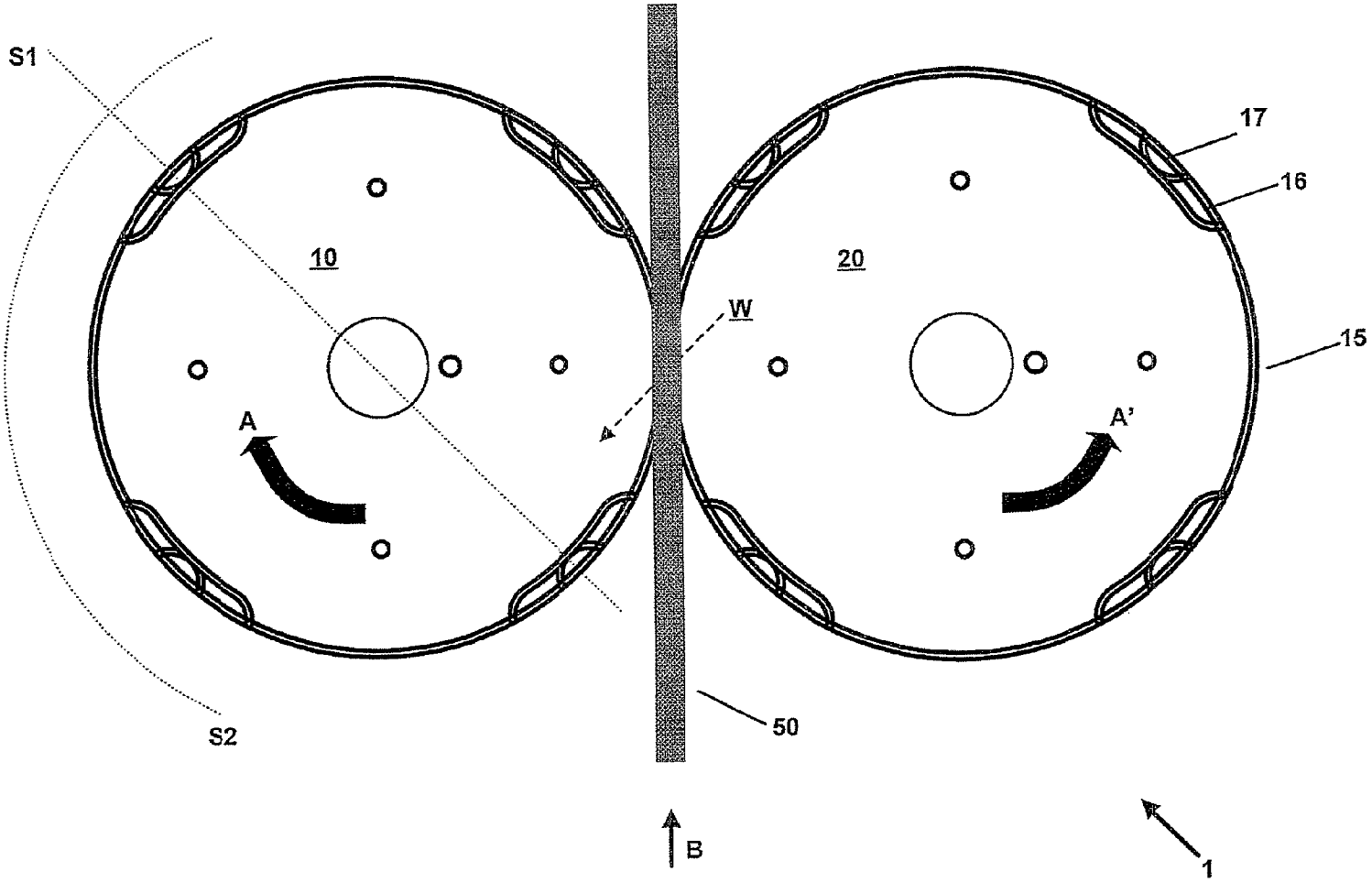
FIG. 1 is a schematic plan view of cigarette manufacturing apparatus in accordance with one embodiment of the invention.

FIG. 1 is a schematic plan view of cigarette manufacturing apparatus 1 in accordance with one embodiment of the invention. The apparatus comprises a pair of coplanar rotating disks 10, 20 substantially adjacent to one another. Note that the disks rotate in opposite directions to one another, so that disk 10 rotates clockwise as indicated by arrow A and disk 20 rotates anti-clockwise as indicated by arrow A'. Disks 10, 20 are known as trimming disks and form part of the ecreteur for removing tobacco from a tobacco rod.

In operation, a tobacco rod 50 is moved over the two disks along a path parallel to the long axis of the tobacco rod. The path of the tobacco rod is substantially tangential to the two rotating disks. The path bisects and is perpendicular to a line joining the centres of the two rotating disks. The motion of the tobacco rod along its path is in the opposite direction to the motion of the portions of the two rotating disks immediately beneath the tobacco rod. Thus as shown in FIG. 1, where the rotation of the two disks is such that they are both moving downwards (with respect to the page) in the vicinity of the tobacco rod path, the tobacco rod itself moves upwards along this path (as indicated by arrow B). This provides a relative motion between the tobacco rod 50 and the rotating disks 10 and 20 which is used to drive the trimming action.

The two rotating disks 10 and 20 in the apparatus 1 are the same as one another. The circumferential region of each rotating disk 10, 20 has three different levels or depths (as measured in a direction perpendicular to the plane of the disk). The first region, denoted as 15 in FIG. 1, is where the edge of the disk is at the same level as the main portion of the disk. This portion of the disk is highest, i.e. closest to the central axis of tobacco rod 50, and so is used to trim off the greatest amount of tobacco from tobacco rod 50.

The second region, denoted as 17 in FIG. 1, is where the depth of the edge portion of the disk is greatest. In other words, region 17 lies furthest below the plane of disks 10 and 20 (and hence furthest from the central axis of tobacco rod 50). This portion of the disk edge 17 is therefore used to trim off the least amount of tobacco from tobacco rod 50.

The third region, denoted as 16 in FIG. 1, is where the depth of the edge portion of the disk has an intermediate value in comparison with regions 15 and 17. This portion of the disk edge is therefore used to trim off an intermediate amount of tobacco from tobacco rod 50—i.e. less tobacco than region 15, but more tobacco than region 17.

The two rotating disks 10 and 20 in apparatus 1 both have the same pattern along their circumference. Furthermore, the pattern of disk 10 is azimuthally aligned with the pattern of disk 20 to synchronise the phase angle for disk 10 with the phase angle for disk 20 (allowing for the opposite sense of rotation). Consequently, when a particular edge region from rotating disk 20, for example region 16, is in contact with the tobacco rod 50, the same region (i.e. region 16) from rotating disk 10 is also in contact with tobacco rod 50. This ensures that tobacco rod 50 is trimmed in a symmetrical fashion about a line corresponding to the central (long) axis of tobacco rod 50.

Figure 2A:
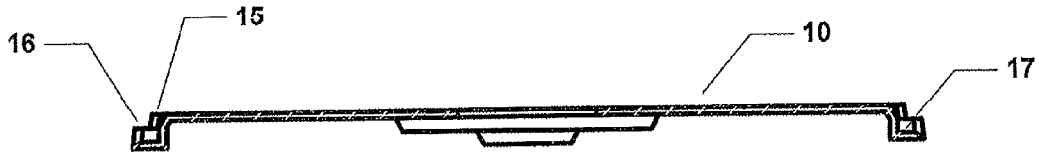
FIG. 2A is a cross-section through an ecreteur disk of the manufacturing apparatus of FIG. 1.

FIG. 2A represents a horizontal cross-section through disk 10 (i.e. perpendicular to the plane of the disk) along line S1 in FIG. 1. The diameter of the cross-section coincides with the location of the deepest pockets on the disk, corresponding to region 17. Also visible in FIG. 2A is the step up to the intermediate level for region 16. The step-up to the highest level of the disk, region 15, which is coplanar with the main body of the disk, is only just visible in FIG. 2A (due to the curvature of the disk).

Figure 2B:
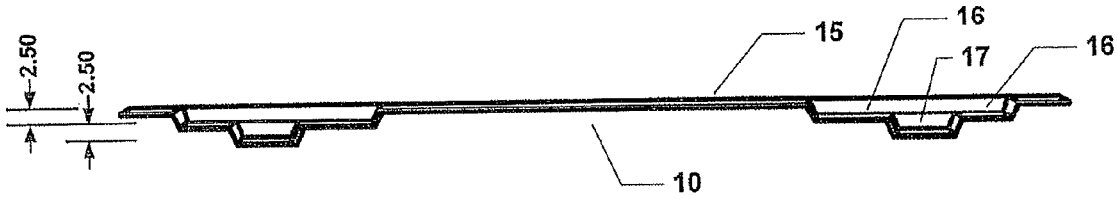
FIG. 2B is a schematic wrap-around view of an ecreteur disk of the manufacturing apparatus of FIG. 1.

FIG. 2B can be considered as a circumferential section through or around disk 10; in other words, it is obtained by following arc S2 in FIG. 1, but always viewing towards the centre of disk 10. As can be seen clearly in FIG. 2B, region 17 forms the deepest portion of the edge of disk 10. A region 16 of intermediate depth is located on either side of region 17. The remainder of the edge of the disk, region 15, lies at the same level as the main body of the disk.

In the embodiment of FIG. 2B, the level of region 16 is approximately 0.25 mm below that of region 15, while the level of region 17 is approximately 0.25 mm below that of region 16. Each pocket extends approximately 7 mm radially inwards towards the centre of disk 10 (whereupon the level of the disk returns to that of region 15, i.e. the main body of the disk). The angular (circumferential) extent of each region 17 is approximately 12 degrees; likewise each portion of region 16 has an angular extent of approximately 12 degrees. The angular extent of region 15 is approximately 54 degrees. (It will be appreciated that these dimensions and angles are illustrative only, and may vary from one embodiment to another).

Figure 3:
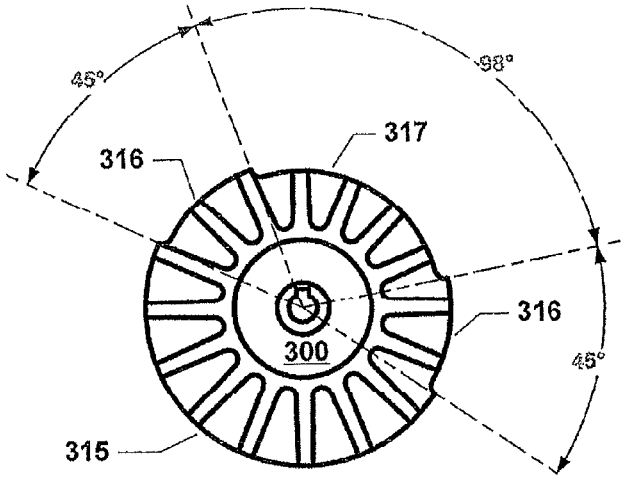
FIG. 3 illustrates an ecreteur brush for use with the manufacturing apparatus of FIG. 1 in accordance with one embodiment of the invention.

FIG. 3 illustrates an ecreteur brush or paddle wheel 300 for use in the manufacturing apparatus 1 of FIG. 1 in accordance with one embodiment of the invention. Wheel 300 is located beneath the trimming disks 10, 20, i.e. on the opposite side of disks 10, 20 from the central axis of tobacco rod 50. In contrast to disks 10 and 20, which are mounted horizontally, wheel 300 is mounted vertically, and rotates about a horizontal axis. This axis is offset to the direction of travel of tobacco rod 50. Arrow W in FIG. 1 lies in the same vertical plane as wheel 300 and also indicates the direction of travel of the top of the wheel 300. In other words, the portion of the wheel 300 immediately below the ecreteur disks 10, 20 travels in the direction of arrow W, and therefore contacts and brushes excess tobacco in the direction of disk 10. (This excess tobacco is then returned for re-use to the hopper from which the suction belt forms tobacco rod 50).

Wheel 300 has a variable radius, corresponding to the variable depth of trimming disks 10, 20. Thus the region 317 of wheel 300 having the shortest radius corresponds generally to the deepest pocket 17 on the trimming disks. This portion of the wheel therefore removes the smallest amount of tobacco from tobacco rod 50. The regions 316 of wheel 300 having an intermediate radius correspond generally to the intermediate pockets 16 on the trimming disks. This portion of the wheel therefore removes an intermediate amount of tobacco from tobacco rod 50. The region 315 of wheel 300 having the greatest radius corresponds generally to the highest level 15 of the trimming disks. This portion of the wheel therefore removes the most tobacco from tobacco rod 50.

It will be appreciated that the edge pattern of disks 10, 20 occurs (repeats) four times per revolution, while the radial pattern of wheel 300 occurs only once for each revolution. Consequently, wheel 300 is rotated at four times the frequency of trimming disks 10, 20, so that each rotation of wheel 300 corresponds to one occurrence (repetition) of the edge pattern of trimming disks 10, 20.

The radial profile and phase angle of wheel 300 is configured to maintain synchronisation with the edge level of the trimming disk. In particular, the circumferential rim of wheel 300 is maintained close to the underside of the edge of trimming disks 10, 20 in order to ensure proper removal of excess tobacco, while at the same time ensuring that the wheel 300 does not catch on the trimming disks 10, 20 (or vice versa). The rim of wheel 300 therefore operates in conjunction with the underside of the trimming disks to remove a varying amount of tobacco from tobacco rod 50.

As indicated in FIG. 3, the angular (circumferential) extent of region 317 is approximately 98 degrees, the angular extent of region 316 is approximately 45 degrees, and the angular extent of region 315 is approximately 172 degrees. These angles are determined by the need to provide clearance for the pockets on the trimming disks. Note that the angular extent of region 317 is larger than the angular extent of corresponding pocket 17, even allowing for the four times step-up in frequency, due to the finite width of the wheel 300 (i.e. as measured in a direction parallel to the axis of rotation). In particular, region 317 has to provide clearance from when the first part of pocket 17 encounters the near face of wheel 300 (as determined by the direction of rotation of the trimming disks) until when the last part of pocket 17 clears the far face of wheel 300. (It will be appreciated that the angles mentioned above are illustrative only, and may vary from one embodiment to another).

Figure 4:
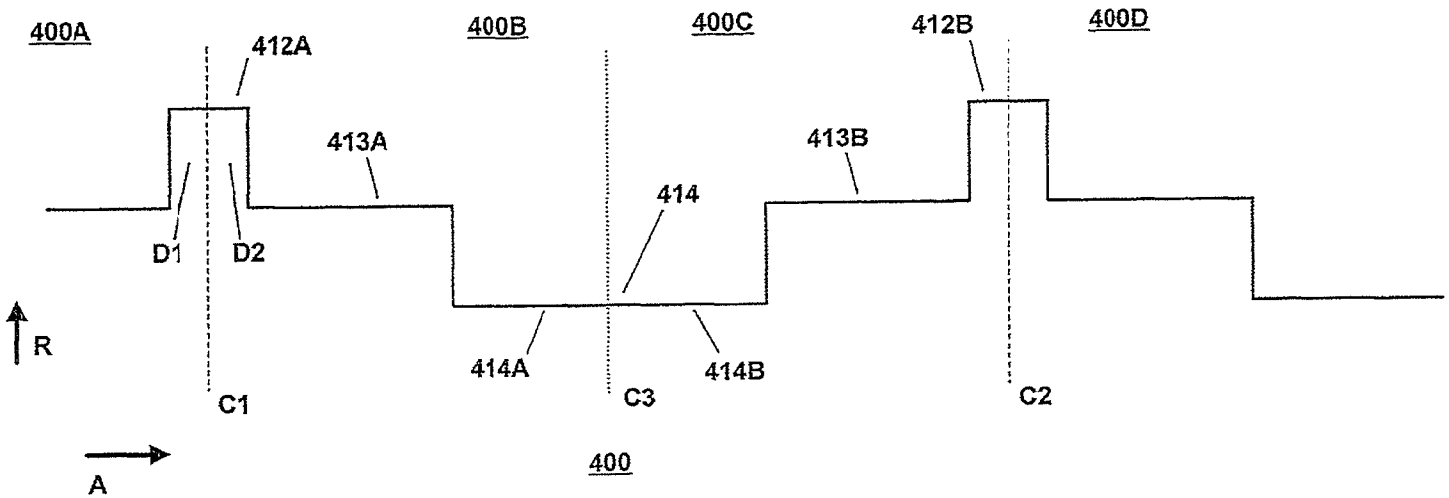
FIG. 4 illustrates the variable profile of a tobacco rod produced by the cigarette manufacturing apparatus of FIG. 1 in accordance with one embodiment of the invention.

FIG. 4 is a schematic illustration of the tobacco rod 400 formed using the manufacturing apparatus of FIG. 1 in accordance with one embodiment of the invention. In this diagram, arrow A indicates the axial direction of the tobacco rod. FIG. 4 illustrates profile or variations of the mass (per unit length) for tobacco rod 400 produced by trimming disks 10, 20 and wheel 300. Since tobacco rod 400 generally has a constant density (in terms of tobacco mass per unit volume) at this stage of processing, the mass variations of FIG. 4 also correspond to variations in thickness, e.g. cross-sectional area or radius, of the tobacco rod 400. (Arrow R in FIG. 4 can therefore be considered as indicating the radial direction of tobacco rod 400). Note that FIG. 4 is not to scale, and mass or size variations have been exaggerated for the sake of clarity.

The portions 414 of tobacco rod 400 having the smallest area or mass per unit length correspond to the highest part of the trimming disks 10, 20, namely region 15, and also to the part 315 of wheel 300 having the largest radius. The portions 412 of tobacco rod having the largest mass per unit length correspond to the deepest part of the trimming disks 10, 20, namely region 17, and also the part 317 of wheel 300 having the smallest radius. The regions 413 of tobacco rod having an intermediate mass per unit length correspond to the intermediate part of the trimming disks 10, 20, namely region 16, and also to the part 316 of wheel 300 having an intermediate radius. Overall therefore, portion 412 has a greater mass of tobacco per unit length than portion 413, which in turn has a greater mass of tobacco per unit length than portion 414.

For a continuous tobacco rod 50 input to the manufacturing apparatus 1, the pattern of variations shown in FIG. 4 repeats. The period of repetition corresponds to the length of two cigarettes. In particular, the portion of the tobacco rod 400 between cut lines C1 and C2 is eventually used to form a pair of cigarettes. Thus sections 400A, 400B, 400C and 400D of tobacco rod 400 end up as different cigarettes. It will be noted that one revolution of the trimming disks 10, 20 corresponds to the production of eight cigarettes (four pairs), since the edge pattern of the trimming disks occurs four times around the circumference of the trimming disks at equal spacing. (It will be appreciated that these ratios may vary depending upon the particular manufacturing apparatus being used).

Although all the cigarettes formed from tobacco rod 400 have the same profile variation, the two cigarettes in each pair of cigarettes have an opposing orientation. In particular, after the section of tobacco rod 400B and 400C is formed by cutting along lines C1 and C2, the two open ends of the cigarettes are at opposite (far) ends of this portion of tobacco rod.

The cut line C1 bisects the portion 412A representing the greatest thickness of the tobacco rod 400 (and corresponding to the deepest region of the cutting disks 10, 20). As a result, portion 412A is split into section D1, which ends up in cigarette 400A, and section D2, which ends up in cigarette 400B. The open end of cigarette 400B therefore comprises portion 412A, or more particularly, the half of portion 412A denoted as D2 in FIG. 4. Similarly, the open end of cigarette 400C comprises the first half of portion 412B.

After making cuts C1 and C2, the tobacco rod corresponding to cigarettes 400B and 400C is wrapped (as described in more detail below). During this wrapping, portion 412A (i.e. D2) is used to form the dense open end of cigarette 400B, since it has the maximum weight of tobacco per unit length. Likewise, portion 412B is used to form the dense open end of cigarette 400C. At a further stage of manufacture (after wrapping), portion 414 is split along cut line C3, and a filter is inserted between portion 414A and portion 414B. This filter is then itself split in two to complete the production of separate cigarettes 400B and 400C.

The term body portion is used herein to refer to the portion of the tobacco rod excluding the dense end(s)—i.e. excluding the region(s) of increased tobacco density at the open end of the cigarette, and optionally at the filter end as well. In a conventional cigarette, the tobacco mass per unit length is generally constant along this body portion, thereby providing consistent smoking and handling qualities.

However, it has been suggested, see for example WO 2005/082180, that the body portion of the cigarette may be provided with an inner wrap in addition to the conventional cigarette paper used for the outer wrap. This inner wrap can be used for providing additional flavouring. Another potential use for the inner wrap is to reduce delivery of certain constituents of the smoke to the consumer during smoking. One motivation for this is to provide a constant delivery from the cigarette as the cigarette is smoked. Thus tobacco within a tobacco rod provides some degree of filtration, but as this tobacco is burnt, so the corresponding filtration is reduced. Providing an inner wrap comprising an adsorbent material towards the filter end of the cigarette reduces the delivery of smoke constituents to the consumer in the final puffs, thereby achieving a flatter overall puff profile (especially for low tar yield products).

In some cigarettes, the inner wrap may be positioned between the two dense ends of tobacco, while in other cigarettes, the inner wrap may extend all the way to the filter end, without there being a dense end at the filter end. This reflects the fact that providing a dense end at the filter end of the cigarette is mainly to assist machine handling of the tobacco rod during manufacture prior to insertion of the filter (since after the filter is inserted, the filter itself serves to retain tobacco in the cigarette). The extra thickness of the inner wrap (compared to conventional cigarette paper) can itself help with machine handling of the tobacco rod, thereby reducing or obviating the need for a dense end of tobacco at the filter end (assuming that the inner wrap extends all the way to the filter end).

If the inner wrap extends along only some of the body portion of a cigarette, then the cigarette will have a dual wrap (the inner wrap and the conventional cigarette paper) for this part of the cigarette, but a single wrap (just the conventional cigarette paper) along the remainder of the cigarette. As an example, a conventional cigarette paper might have a thickness of 0.05 mm, while an inner wrap might have a thickness of approximately 0.17 mm, compared to a total radius for a cigarette of approximately 3.9 mm. (It will be appreciated that these numbers are illustrative only, and will vary according to the particular cigarette and wrappings involved).

Having the dual wrap extend along only part of the body portion of the cigarette produces a discontinuity in the overall thickness of the wrapping. This may lead to a non-uniform feel for the cigarette, corrugation of the outer paper wrapping. and/or rod break-out. In addition, the tobacco may be more compressed under the dual wrap, leading to inconsistent smoking characteristics.

Therefore, in accordance with one embodiment of the invention, the profile shown in FIG. 4 is used to accommodate a cigarette having a (partial) dual wrap. In particular, the central region 414 of the cigarette having the lowest tobacco mass per unit length corresponds to the portion provided with the dual wrap, whereas the portions 413 having a higher tobacco mass per unit length are provided with just a single wrap. This then allows the inner wrap, in effect, to sit in the region of reduced tobacco radius.

In one particular embodiment, a long roll of (outer) cigarette wrapping paper is provided on a periodic basis with portions of inner wrap. The sizing and spacing of this inner wrap corresponds to the sizing and spacing of reduced tobacco portions 414 of tobacco rod 400, whereby each reduced thickness portion 414 receives a dual wrapper.

The thickness of the inner wrap corresponds approximately to the depth of region 414 compared to region 413, having regard to any compression of the inner wrap and/or tobacco when the outer wrap, namely the cigarette paper, is applied. (Thus the 0.25 mm depth of the pocket in trimming disk 10 is slightly greater than the 0.17 mm thickness of the inner wrapper, since the tobacco is compressed somewhat during the wrapping process). This approach helps to ensure that a constant density of tobacco is maintained along the length of the cigarette through the discontinuity where the inner wrap stops/starts, while also reducing or avoiding any localised stress or strain on the outer wrap at this discontinuity. This in turn offers improved handling and smoking characteristics for a cigarette having a (partial) dual wrap.

The profile of FIG. 4 only has a tobacco dense end at the open end of the cigarette, but not at the filter end. As previously mentioned, one reason for this is that the inner wrap itself can help to provide stability at the filter end, thereby reducing or eliminating the need for a dense end here during manufacture. This also reflects the fact that machinery for forming a dense end at either end of a cigarette is also more complicated. In particular, having dense ends at both ends of a cigarette may involve portion 15 of the trimming disks 10, 20 incorporating a pocket of the is same depth as pocket 17, but without having the intermediate steps (in effect) of depth 16 on either side. Such an abrupt change in depth of the trimming disk may cause problems with the trimming action, both in terms of implementing the sudden change in rate of tobacco trimming, and also in terms of configuring wheel 300 to track, but not to interfere with, such a disk profile. One possibility might be to implement the increased density of the dense end within the dual wrap portion, in which case the radius of this dense end might only correspond to pocket 16 (rather than to pocket 17).

In one embodiment, rather than having a dual wrap in the central portion of the cigarette, the dual wrap may have a different position on the cigarette. In addition, some cigarettes may be provided with a different or more complicated set of variations in mass per unit length than shown in FIG. 4—e.g. more levels of mass per unit length and/or more transitions between the different levels. In addition, various profiles may be used for the transitions, such as step, slanting, curved, etc (as described in more detail below).

Although the manufacturing apparatus of FIG. 1 uses multi-level rotating disks 10, 20 to generate the variations in thickness for a tobacco rod such as shown in FIG. 4, other implementations may use a fully planar disk in conjunction with a trimming wheel of constant radius. A cam mechanism then provides a controlled amount of compression to the tobacco rod 50 prior to reaching the ecreteur. If a relatively large amount of compression is applied, the tobacco rod 50 has a relatively small cross-section, and hence less tobacco is removed by the ecreteur (since the tobacco is generally closer to the central axis of the tobacco rod, and therefore less tobacco lies below the plane of the ecreteur disks). Consequently, the tobacco mass per unit length of the resulting tobacco rod is relatively high. Conversely, if a relatively small amount of compression is applied, the tobacco rod 50 has a relatively large cross-section, and hence more tobacco is removed by the ecreteur—i.e. the tobacco mass per unit length of the resulting tobacco rod is relatively low. Accordingly, such a cam mechanism can be used to obtain the thickness or mass profile of FIG. 4 (or any other desired profile). One advantage of this approach is that a different profile can be achieved just by changing the cam mechanism, without having to change the trimming disks or wheel.

A similar advantage can be achieved in manufacturing apparatus in which the ecreteur disk and wheel are moved up and down together, in constant relationship with one another, towards and away from the tobacco rod 50, in order to vary the amount of tobacco trimmed from tobacco rod 50. In particular, the motion of the disk and wheel may be controlled in accordance with the desired variations in thickness of the output tobacco rod, for example as shown in FIG. 4.

Figure 5:
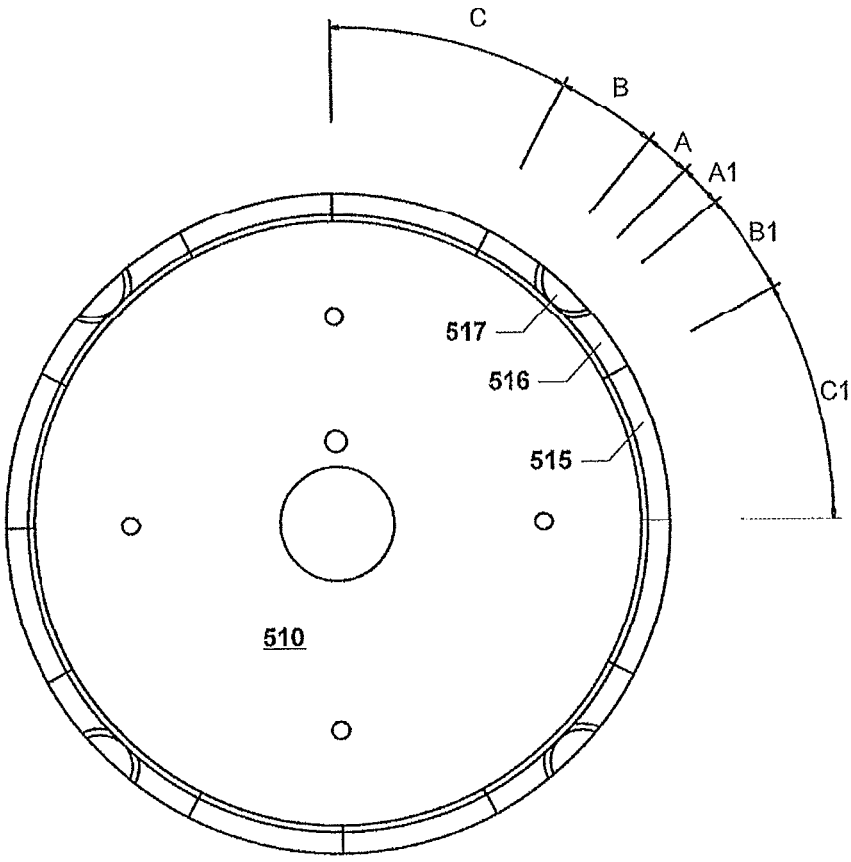
FIG. 5 is a schematic plan view of an ecreteur disk for use in cigarette manufacturing apparatus in accordance with another embodiment of the invention.

Although the embodiment of FIGS. 1-4 relate to an ecreteur with two step changes in level (per cigarette), many other configurations are possible. FIG. 5 illustrates an ecreteur disk having one step change and one gradual change in level (per cigarette). In particular, the ecreteur disk 510 of FIG. 5 is provided with a first region comprising a deep pocket 517 to form a dense end, and then has a second region of intermediate level 516. Finally, a third region 515 is provided which generally has the highest, albeit gradually changing, level. Thus where the third region joins the second region, the level of the third region matches the second region. The level of the third region then steadily increases moving away from the second region until it reaches the level of the main body of the disk. The pattern is then repeated in reverse, whereby the level of the outside region of the disk falls gradually away again towards another intermediate region and then another deep pocket. These changes of level can be seen in the profile view of FIG. 6 (which corresponds in geometry to FIG. 2B).

Disk 510 produces 8 cigarettes per revolution, with each quarter of the disk producing a pair of opposing cigarettes (as per the disks 10, 20 of FIG. 1). For example, regions A and A1 in FIG. 5, which are formed in a single deep pocket 517, provide the dense ends for two different cigarettes. A first cigarette comprises the first dense end region A, a second region of intermediate tobacco mass per unit length denoted as B and formed by level 516, and a third region of gradually changing tobacco mass per unit length denoted as C and formed by a gradually changing level 515. Likewise, a second cigarette comprises the first dense end formed by region A1, a second region of intermediate tobacco mass per unit length corresponding to B1 and formed by level 516, and a third region of gradually changing tobacco mass per unit length corresponding to C1 and formed by another gradually changing level.

In one embodiment, region C for the first cigarette extends between the intermediate section (denoted as B) and the cigarette filter. The maximum height of the ecreteur disk edge corresponds to where region C is to abut against the filter. Similarly for the second cigarette of the pair, the maximum height of the ecreteur disk edge corresponds to where region C1 is to abut against the filter.

In one embodiment, pocket 517 is formed at a depth of approximately 2.5 mm below region 516, while the level of region 516 is approximately 2.5 mm below the highest point of portion 515. In other words, the gradual descent of portion 515 (corresponding to region C or C1) produces a total drop of about 2.5 mm, which is about the same as the drop from portion 516 into pocket 517. (It will be appreciated that other embodiments may have different changes in level).

Figure 6:
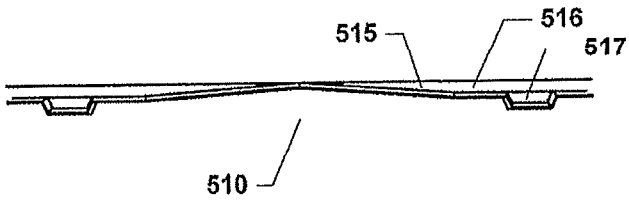
FIG. 6 is a schematic wrap-around view of the ecreteur disk of FIG. 5.
Figure 7:
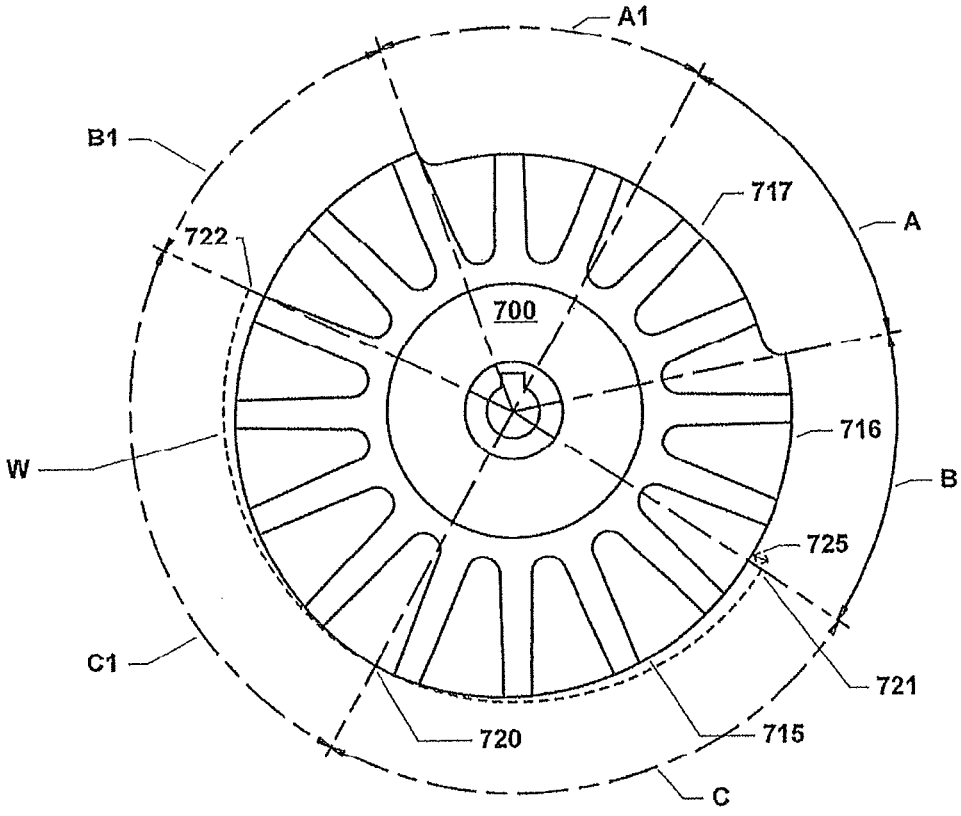
FIG. 7 illustrates an ecreteur brush for use with the ecreteur disk of FIG. 5 in accordance with one embodiment of the invention.

FIG. 7 illustrates an ecreteur brush or wheel 700 for use with the ecreteur disk 510 of FIGS. 5 and 6 in accordance with one embodiment of the invention. As for the previous embodiment of FIG. 3, ecreteur wheel 700 outputs one pair of cigarettes per rotation, and so has a rotation frequency that is four times that of disk 510 (but other embodiments may use other ratios). The deepest region 717 (i.e. having the smallest radius) of ecreteur wheel 700 and denoted A and A1 is used to form a pair of adjacent dense ends.

(It will be appreciated that regions A and A1 of wheel 700 correspond to regions A and A1 respectively of disk 510 in FIG. 5. In particular, the rotations of wheel 700 and disk 510 are synchronised so that region A of disk 510 and region A of wheel 700 both arrive at the tobacco rod together, likewise for the A1 regions).

An intermediate region 716 (i.e. having an intermediate radius) of ecreteur wheel 700 and denoted B (and B1) is used to form a region of standard tobacco mass per unit length. Finally, a region 715 of ecreteur wheel 700 having a steadily increasing radius and denoted C is used to form a region of decreasing tobacco mass per unit length, whereby the filter end of the tobacco rod has the lowest level of tobacco mass per unit length. This pattern then reverses, so that on further rotation, the height of the trimming disk edge for region C1 gradually falls back to the intermediate level of region B1, which in turn falls to the level of pocket 717 to allow region A1 to form a dense end. (Again, regions B, B1, C and C1 of wheel 700 correspond to regions B, B1, C and C1 respectively of disk 510).

The changing radius of ecreteur wheel 700 is illustrated by the dashed line of curve W, which forms an arc of constant radius, corresponding to the maximum value of the radius for ecreteur wheel 700. This maximum radius occurs at position 720, which coincides with the boundary between region C and C1. (In one embodiment, this is where there will eventually be a cut between the two cigarettes of the tobacco rod formed by one rotation of wheel 700 to allow the insertion of filter material).

The radius of wheel 700 decreases with angular position away from position 720, as can be seen by the increasing discrepancy between arc W and the outer surface of wheel 700. This decrease in wheel radius becomes steadily greater with angle through portion C until position 721, which represents the transition from portion C to portion B (which has a constant, intermediate radius). There is a corresponding decrease on the other side of the wheel 700 through region C1 around to position 722, which corresponds to the transition from portion C1 to portion B1.

The total change in radius of wheel 700 through region C or C1, i.e. the change from position 720 around to position 721 or 722, is indicated in FIG. 7 by arrow 725. It will be noted that this total change in radius 725 is approximately equal to the step change in radius at the transition from region B 716 to region A 717 (or to the step changes shown in FIG. 3).

Figure 8:
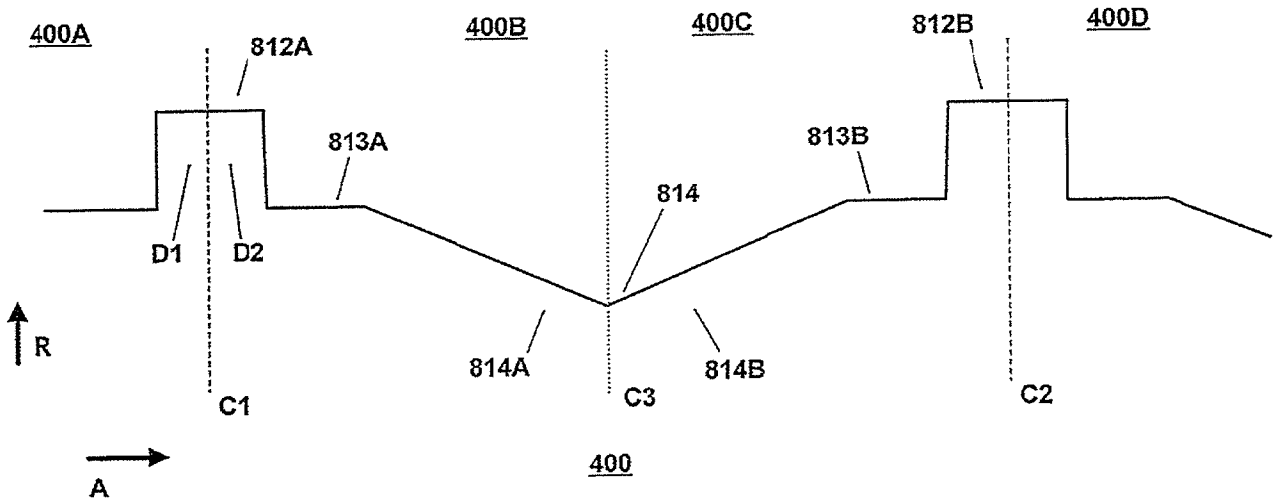
FIG. 8 illustrates the variable profile of a tobacco rod produced by the ecreteur disk of FIG. 5 in accordance with one embodiment of the invention.

FIG. 8 is a schematic illustration of a tobacco rod formed using ecreteur disk 510 (and wheel 700). FIG. 8 generally corresponds to FIG. 4, in that again regions 400A, 400B, 400C and 400D will each end up as a different cigarette. In addition, each cigarette comprises three portions, 812, 813, and 814. However, unlike for FIG. 4, there is no step change in the mass of the tobacco rod for FIG. 8, apart from at the transition to the dense end (i.e. between regions 812A and 813A). Rather, after an intermediate stage 813A, 813B, the tobacco mass per unit length gradually reduces during portion 814A, 814B to a minimum value which is attained at cut line C3.

The profile of FIG. 8 may be adopted to help control the smoking characteristics of a cigarette. For example, the mass of tobacco per unit length might be reduced near the filter end of the cigarette to help control the delivery rate of smoke constituents to the consumer as the cigarette is burned. In one embodiment, this variation in tobacco mass per unit length is accommodated within a single (standard) wrap of cigarette paper (thereby leading to generally reduced density of tobacco near the filter end).

Another possibility is to replace in effect the displaced tobacco with an inner wrap to provide additional flavouring, more consistent delivery of smoke constituents, etc., as suggested in the above-referenced WO 2005/082180. However, rather than having a rectangular inner wrap (aligned with the axial direction of the tobacco rod), other shapes might be used for the wrap.

Figure 9:
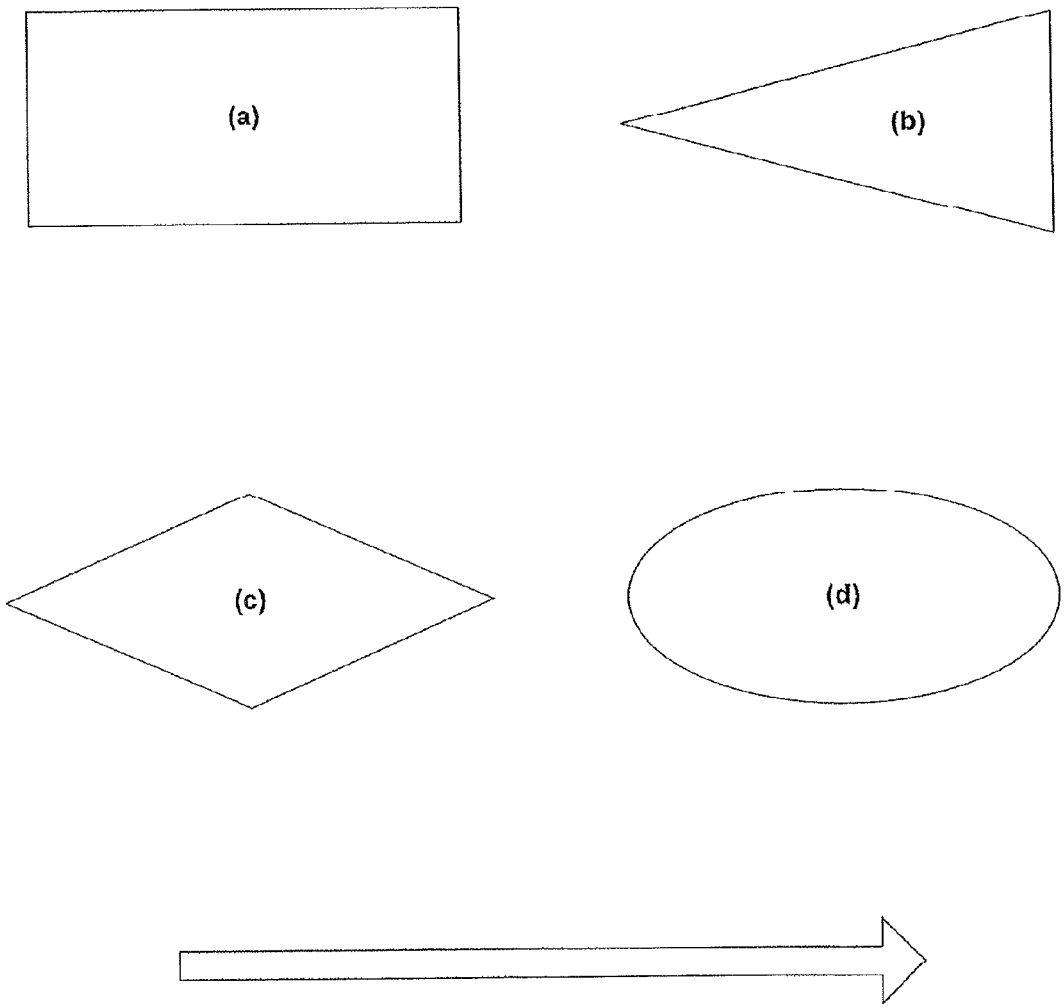
FIG. 9 illustrates various inner wrap shapes for use in a cigarette in accordance with various embodiments of the invention.

FIG. 9 illustrates examples of various patch shapes (it will be appreciated that many others are possible): (a) rectangular; (b) triangular; (c) diamond; and (d) ellipse. The large arrow at the bottom of FIG. 9 illustrates the direction of combustion along the axis of the cigarette. Note that the length of any given wrap may be such as to extend along all or only part of the tobacco rod for a cigarette. Perpendicular to the arrow is the circumferential direction (when the wrap is wrapped around the cigarette). Depending on the width of the wrap, the wrap may or may not extend around the whole circumference of the cigarette.

The rectangular wrap (a) might be used with the tobacco profile shown in FIG. 4. In other words, the wrap would coincide with the region of lowest tobacco mass 414A, 414B. As previously discussed, the thickness of the wrap may correspond to the reduction in tobacco mass, thereby providing a constant tobacco density along the length of the tobacco rod through any transition(s) between no inner wrap and inner wrap.

The triangular wrap (B) might be used with the tobacco profile shown in FIG. 8. In other words, the wrap would coincide with the region of decreasing tobacco mass 814A, 814B. The reduction in width of the wrap (and hence circumferential coverage) along the length of the tobacco rod may correspond to the reduction in tobacco mass, so that the tobacco density is again constant along the length of the tobacco rod through any transition(s) between no inner wrap and inner wrap, and also along the length of the inner wrap itself.

One reason for using the triangular wrap (b) is to allow the wrap to produce a more gradual effect. For example, if the wrap provides a flavour, the amount of flavour initially released when the narrow end of the triangular wrap starts to burn is relatively low (since the wrap is narrow). The amount of flavour then starts to increase steadily as the cigarette is consumed along to wider and wider portions of the wrap. This gradual onset and then increase of flavour may be more attractive to consumers than the more sudden onset of the rectangular wrap (a).

Although the triangular wrap (b) has a gradual onset, there is an abrupt ending of the wrap (as for the rectangular wrap (a)). Although this may not be noticeable if the inner wrap abuts the filter (since at this point the cigarette is finished anyway), the diamond and elliptical wraps ((c) and (d) respectively) both provide both a gradual onset and also a gradual termination of the inner wrap.

Another reason for providing a gradual decrease in the thickness of the wrap along the length of the tobacco rod may be to compensate for the reduction in remaining length of the cigarette. For example, since the flavour from the inner wrap is now being generated nearer to the consumer, the width of the inner wrap required to produce a given strength of flavour for the consumer may also be reduced nearer to the filter end of the cigarette.

It will be appreciated therefore that there are many potential factors influencing the desired mass per unit length of tobacco along a cigarette (whether with or without an inner wrap). Accordingly, many different configurations of tobacco mass per unit length of tobacco might be produced, not just those shown in FIGS. 4 and 8. Moreover, such tobacco profiles may be produced using any suitable apparatus, such as the ecreteur systems shown in the Figures, a cam mechanism, etc.

Thus the skilled person will be aware of many possible modifications and variations on the embodiments so far described. For example, although the present approach has been described generally in the context of cigarettes, it can be applied to a wider range of smoking articles, e.g. cigars. Accordingly, the scope of the present invention is defined by the appended claims and their equivalents.

The invention claimed is:

1. An apparatus for manufacturing a smoking article comprising an ecreteur having at least one trimming disk configured to trim a tobacco rod for a smoking article to have an end region of increased tobacco density, wherein said at least one trimming disk comprises an edge with a first segment for trimming a region corresponding to the end region of increased tobacco density and a second segment for trimming a body region, said body region being distinct from said region corresponding to said end region of increased tobacco density, wherein the second segment of the trimming disk has a variable trimming depth to trim the body region of the tobacco rod such that said body region has a variable tobacco mass per unit length, wherein said body region has a first portion and a second portion and the second segment of said trimming disk is configured to trim more tobacco from the first portion of the body region than the second portion of the body region, wherein the second portion of the body region is intermediate the first portion of the body region and the end region of increased tobacco density; and wherein a part of the second segment that is configured to trim the second portion of the body region has a substantially constant trimming depth.

2. The apparatus of claim 1, wherein a part of the second segment that is configured to trim the first portion of the body region has a trimming depth which variable along the length of the first portion.

3. The apparatus of claim 1, further comprising a garniture area configured to wrap the trimmed tobacco rod in an inner wrap and an outer wrap such that the inner wrap is coextensive with the first portion of the body region and the outer wrap extends over at least all of the body region.

4. The apparatus of claim 3, wherein the trimming disk trims the tobacco rod and the garniture area provides the inner and outer wraps to the trimmed tobacco rod so that the cross-sectional area of the smoking article is substantially constant and at any given position along the first portion of the smoking article, the tobacco mass per unit length and the size of the inner wrap combine to produce a constant density of tobacco along the first portion.

5. The apparatus of claim 4, wherein the first segment and second segment of the edge of the trimming disk are configured to trim the tobacco rod such that the constant density of tobacco along the first portion is the same as a constant density of tobacco along the second portion.

6. The apparatus of claim 1, further comprising at least one ecreteur brush positioned so that the outer face of the brush is adjacent to the trimming disks, and wherein the radius of the ecreteur brush varies corresponding to the varying level of the edge of the trimming disks.

7. The apparatus of claim 6, wherein the radius of the ecreteur brush has a first value corresponding to said at least one end region of increased tobacco density, a second value corresponding to the first portion of the body region where a dual wrap is to be accommodated, and a third value corresponding to the second portion of the body region, wherein said third value is intermediate said first value and said second value.

* * * * *

UNITED STATES PATENT AND TRADEMARK OFFICE

CERTIFICATE OF CORRECTION

PATENT NO. : 8,602,035 B2
APPLICATION NO. : 12/525526
DATED : December 10, 2013
INVENTOR(S) : Karl Kaljura It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1184 days.

Signed and Sealed this
Thirty-first Day of March, 2015

Michelle K. Lee

Michelle K. Lee
*Director of the United States Patent and Trademark Office*